United States Patent [19]

Valev

[11] Patent Number: 4,926,800

[45] Date of Patent: May 22, 1990

[54] OIL-COOLED INTERNAL COMBUSTION ENGINE

[75] Inventor: Assen Valev, Perchtoldsdorf, Austria

[73] Assignee: Steyr-Daimler-Puch, Vienna, Austria

[21] Appl. No.: 336,749

[22] Filed: Apr. 12, 1989

[30] Foreign Application Priority Data

Apr. 29, 1988 [AT] Austria ..... 1103/88

[51] Int. Cl.[5] ..... F01P 3/02

[52] U.S. Cl. ..... 123/41.42; 123/41.08; 123/41.29; 123/41.33

[58] Field of Search ..... 123/41.33, 41.42, 41.44, 123/41.08, 41.09, 41.28, 41.29

[56] References Cited

U.S. PATENT DOCUMENTS

| | | | |
|---|---|---|---|
| 4,364,339 | 12/1982 | Fricker et al. | 123/41.42 |
| 4,708,095 | 11/1987 | Luterek | 123/41.42 |
| 4,834,029 | 5/1989 | Wahnschaffe et al. | 123/41.42 |

FOREIGN PATENT DOCUMENTS

| | | |
|---|---|---|
| 1807639 | 8/1969 | Fed. Rep. of Germany . |
| 2810980 | 9/1979 | Fed. Rep. of Germany . |
| 3509095 | 10/1985 | Fed. Rep. of Germany . |
| 3618794 | 12/1987 | Fed. Rep. of Germany . |

*Primary Examiner*—Noah P. Kamen

*Attorney, Agent, or Firm*—Marmorek, Guttman & Rubenstein

[57] ABSTRACT

An oil-cooled internal combustion engine comprises an oil pan, containing a common oil sump for a lubricating oil circuit and a cooling oil circuit. Each oil circuit contains a separate oil pump. The cooling oil circuit is directly connected to the sump and a lubricating oil circuit, comprising an oil filter and an oil cooler, is connected to the cooling oil circuit. A secondary cooling oil circuit branches off from the lubricating oil circuit dowstream of the oil cooler, and services engine portions which are subjected to particularly high temperatures, requiring increased cooling.

16 Claims, 1 Drawing Sheet

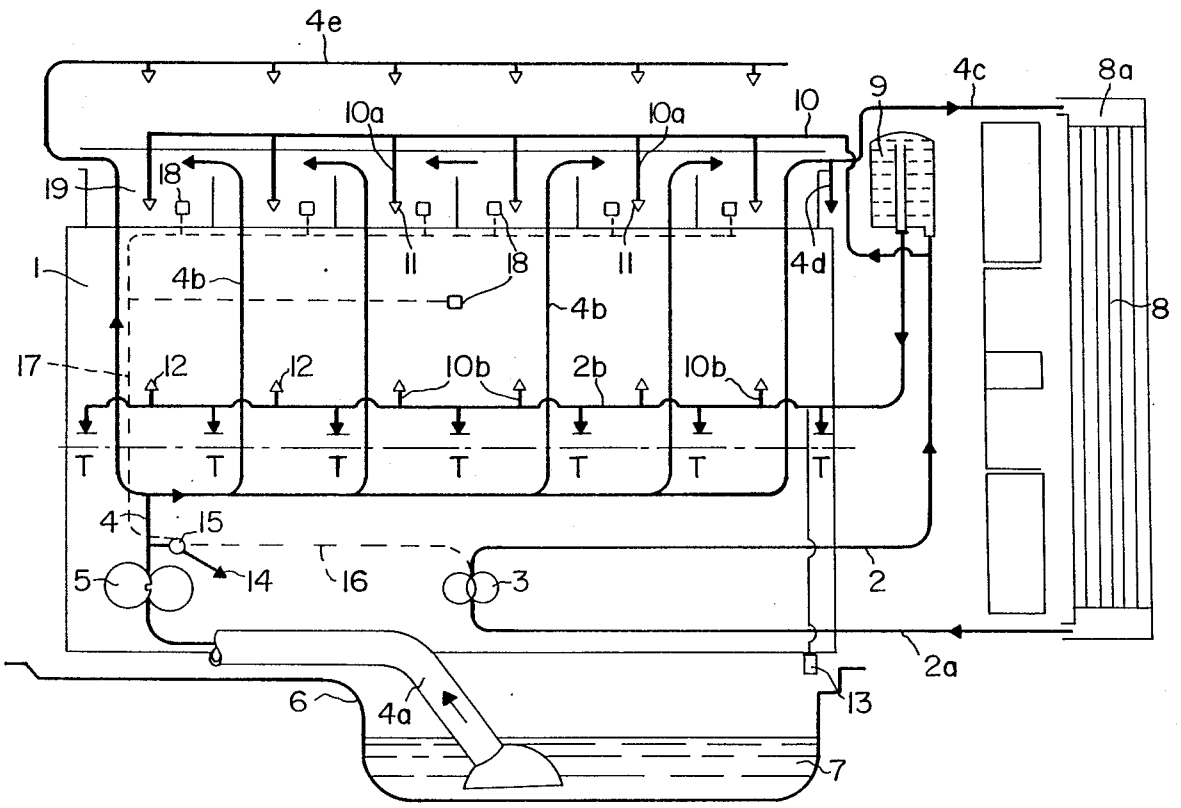
8
8a
4c
9
10
4d
10a
10b
11
4b
2b
18
12
4e
19
1
17
2
2a
13
7
3
16
15
14
4
5
6
4a

OIL-COOLED INTERNAL COMBUSTION ENGINE

FIELD OF THE INVENTION

This invention relates to an oil-cooled internal combustion engine comprising an oil pan, which contains a common oil sump for a lubricating oil circuit and a cooling oil circuit, wherein each of the oil circuits contains a separate oil pump. The cooling oil circuit is directly connected to the oil sump; the lubricating oil circuit, comprising an oil filter and an oil cooler, is connected to the cooling oil circuit.

BACKGROUND OF THE INVENTION

In Published German Application No. 28 10 980 it has been proposed that, in an oil-cooled internal combustion engine in which oil is used to lubricate and to cool the engine, the cooling oil circuit should be in series with, and downstream of, the lubricating oil circuit, even though, in that case, the initial temperature of the cooling oil will be rather high and a high cooling oil flow rate will be required for adequate dissipation of heat. In addition, all of the cooling oil and lubricating oil will have to be recirculated through the oil cooler and the oil filter and this will involve considerable additional structural and power requirements. Moreover, carbonization of oil on the hottest portions of the engine may occur so that additional water cooling of such portions will be required.

Published German Application No. 35 09 055 discloses an oil-cooled internal combustion engine in which the lubricating oil circuit is in series and downstream of the cooling oil circuit so that warmed-up oil can be supplied to the lubricating points of the engine as the latter is warming up. But because that lubricating oil circuit branches off before the oil cooler of the cooling oil circuit, the temperature of the lubricating oil will remain substantially uncontrolled and a desirable cooling of high-temperature portions of the engine cannot be achieved.

From Published German Application No. 36 18 794 it is known to connect a lubricating oil circuit and a cooling oil circuit in parallel in an oil-cooled internal combustion engine. Each of the circuits is connected to a common oil sump and has a separate oil pump. The oil pumps discharge oil under different pressures. If the oil cooler is included in the lubricating oil circuit, the oil cooler will be subjected to the lubricating oil pressure and will cool the lubricating oil to a temperature which is much lower than the temperature of the oil sump; cooling oil from the oil sump will be supplied to the critical portions of the engine, such as the valve-carrying webs, the nozzle seats and the like and will be at an excessively high temperature. On the other hand, if the oil cooler is included in the cooling oil circuit, it will be subjected to a lower pressure and the critical portions of the engine can be cooled with relatively cool oil; however, the lubricating oil will be at the same temperature as the oil in the oil sump and can be cooled to a sufficiently low temperature only with a high cooling effort. In that case, high-temperature parts cannot adequately be cooled because the oil which is available for cooling the cylinder head will not be at a lower temperature than the oil in the oil sump and, in view of the critical points at the cylinder heads, the oil in the oil sump cannot be as cool as would be required for an adequate cooling of high-temperature portions. Whereas it is more desirable from a functional aspect to include the oil cooler in the lubricating oil circuit, the high pressure to which the oil cooler will then be subjected requires for the oil cooler an expensive design which is also unfavorable from the aspect of heat transfer.

A further disadvantage of the known oil-cooled internal combustion engines is that the oil level can be checked only with difficulty. Unless special means are provided, the cooling oil will gradually seep through the cooling oil pump and back into the oil sump when the engine is out of operation so that the oil level cannot be checked unless the engine has been out of operation for a rather long time. If the oil return passages contain special means, such as check valves, a return flow of oil before a check of the oil level will be prevented, but will also be prevented during an oil change, which is undesirable.

Published German Application No. 18 07 639 discloses a lubricating and cooling system which comprises a conventional engine-cooling system and in addition a special piston-cooling line, which branches from the lubricating oil circuit downstream of the oil cooler. This piston-cooling line will be opened only in dependence on the lubricating oil pressure and may be used only to supplement a conventional engine-cooling system so that the structural requirement will be increased.

SUMMARY OF THE INVENTION

It is an object of the invention to eliminate these disadvantages and to provide an oil-cooled internal combustion engine which is of the kind described first hereinbefore and which is distinct by providing for an effective cooling and, particularly, for a highly effective cooling of high-temperature portions by means which involve only a relatively minor additional structural requirement.

That object is accomplished in accordance with the invention in that a secondary cooling oil circuit branches from the lubricating oil circuit downstream of the oil cooler and extends to engine portions which are subjected to particularly high temperatures so that the require intense cooling. In the secondary cooling oil circuit, oil at a low temperature is used to cool critical portions of the engine so that such extremely hot portions will adequately be cooled even if the normal cooling oil circuit is operated at a high temperature. The peak temperatures of the cylinder heads, or of other engine portions which are subjected to high temperatures, may be cooled to desired temperatures, but the average temperature will be increased so that the thermally induced stresses will be decreased, combustion conditions will be improved, fuel consumption will be decreased and other advantages will be realized.

For adequate cooling of the delicate portions of the engine the secondary cooling oil circuit may comprise external lines for effecting a surface cooling, e.g., of the valve-carrying web portions of a cylinder head, and/or internal lines for effecting an internal cooling. The internal lines may consist, e.g., of stub lines, which branch from the main lubricating oil passage and serve for piston cooling. The external and external lines will permit a controlled supply of the additional cooling oil and will ensure an intense cooling of the particularly endangered portions. The secondary cooling oil circuit is not a selfcontained circuit but, depending on the design of the engine, may be composed of various branch and stub lines which are supplied with cool oil from the lubricating oil circuit.

Desirable pressure and flow conditions will be obtained if, in accordance with a preferred feature of the invention, the lubricating oil pump is downstream of the oil cooler, and the secondary cooling oil circuit branches off from the lubricating oil circuit downstream of the lubricating oil pump. In that case the lubricating oil pump will suck cool oil directly from the oil cooler and will deliver that cool oil over a short distance to the lubricating oil passages and to the secondary cooling oil circuit. The oil cooler, located on the suction side of the lubricating oil pump, may be inexpensive and designed for an effective heat transfer.

In accordance with a preferred feature of the invention the cooling oil pump handles oil at a higher rate than the lubricating oil pump, so that the excess oil can be branched off before the oil cooler and returned to the cooling oil pump via engine spaces, completely by-passing the lubricating oil circuit. In that case the cooling system will be economical and inexpensive because the lubricating oil pump which operates against a high backpressure is required to handle oil only at a relatively low rate so that the energy consumption will be low and a simple oil cooler and a simple oil-cooling fan may be employed. The higher rate of cooling oil is required to be circulated by the cooling oil pump only against a relatively low backpressure. When the cooling oil has flown through the cooling spaces, the cooling oil which has been handled in excess of the oil handled by the lubricating oil pump is separated from the oil which is returned to the lubricating oil circuit and the separated oil is directly returned to the oil sump. As the excess oil is mixed with the relatively cool oil which is returned from the lubricating oil circuit and the secondary cooling oil circuit, the oil will assume a final temperature, which will determine the temperature of the oil in the oil sump.

To permit use of the oil cooler also as an oil reservoir, a further feature of the invention provides that the oil filter, which follows the oil cooler, or a riser pipe following the oil cooler, should be, approximately, on the same level as the inlet of the oil cooler so that oil cannot flow out of the oil cooler even when the oil pumps are not operating.

In accordance with a preferred feature of the invention the cooling oil circuit also comprises a return line for a return flow which by-passes the cooling oil pump and said return line contains a pressure- and/or temperature-controlled check valve so that the cooling oil circuit can easily be adapted to different operating conditions.

If the check valve is connected by a control line to the discharge side of the lubricating oil pump and is arranged to open in response to a drop of the lubricating oil pump discharge pressure below a predetermined value, the return line can be used for a rapid emptying of the cooling oil circuit when the engine is turned off so that a quick and reliable check of the oil level will be permitted whereas an oil change will not adversely be affected. If the cooling oil circuit is emptied when the engine has been stopped, no oil carbon will form in the cooling circuits on portions which may exhibit a temperature rise due to overheating of the engine when the cooling means are ineffective.

If the check valve is arranged to open in dependence on the temperature of a portion of the engine, e.g., the temperature of the cylinder head, and to close only when that temperature exceeds an upper limit, the engine will not be cooled when it is first started and warming up; thus it will reach the required operating temperature very quickly. This will be desirable as regards the emission of pollutants, fuel consumption, and wear.

In accordance with a preferred feature of the invention the check valve may be used for an automatic control in response to at least one operating temperature of the engine so that the cooling system may be operated as a function of the operating condition of the engine.

BRIEF DESCRIPTION OF THE DRAWING

The drawing is a diagrammatic view illustrating an internal combustion engine which embodies the invention.

DETAILED DESCRIPTION OF THE PREFERRED EMBODIMENT

An oil-cooled internal combustion engine 1 comprises a lubricating oil circuit 2 that contains a lubricating pump 3, and a cooling oil circuit 4 that contains a cooling oil pump 5. The oil pan 6 of the internal combustion engine 1 contains an oil sump 7, which is connected to both oil circuits 2, 4. The cooling oil circuit 4 extends from the oil sump 7. The lubricating oil circuit 2 is connected to the cooling oil circuit 4 and includes an oil cooler 8 and an oil filter 9. Downstream of the lubricating oil pump 3, a secondary cooling oil circuit 10 branches from the lubricating oil circuit 2 and serves to cool high-temperature portions of the engine from which heat is to be dissipated at a high rate. For that purpose, the secondary oil circuit 10 comprises external lines **10*a* provided with spray nozzles 11 for cooling the valve-carrying webs of the cylinder heads, and internal lines 10*b* provided with spray nozzles 12 for piston cooling. The oil filter 9 in the lubricating oil circuit 2 is situated approximately on the level of the inlet 8a of the oil cooler so that the oil cooler 8 cannot be emptied when oil pumps 3 and 5 are out of operation. As a result, the oil cooler 8** can be used as an oil reservoir.

The cooling oil pump 5 sucks cooling oil at a relatively high rate through a suction line **4*a* and delivers the cooling oil against a relatively low backpressure of about 0.5 bars to the cooling oil circuit 4, which extends through suitable cooling jackets and cooling passages 4*b* around the cylinder liners and into the cylinder heads. The hot cooling oil leaves the engine block and in part flows through a connecting line 4*c* into the oil cooler 8. Another flows through cylinder head outlets 4*d* and by-passes the lubricating oil circuit 2 and is directly returned to the oil sump 7. If the engine 1 is encapsulated, a sprinkling line 4*e* extending from the cylinder head outlets may be used to sprinkle oil onto the encapsulated walls. The oil which has thus been sprinkled will also by-pass the lubricating oil circuit 2 as it is returned to the oil sump 7. As the oil returning to the oil sump is mixed with the much cooler oil which returns from the lubricating oil system and from the secondary cooling oil system 10, the returning cooling oil with be cooled to be mixed temperature which will determine the temperature of the oil in the oil sump 7**.

The lubricating oil pump 3 handles oil at a much lower rate than the cooling oil pump 5, e.g., at one-half of the rate of the latter, and against a much higher backpressure, e.g., of 4.5 bars. Only oil at the rate which is handled by the lubricating oil pump 3 flows through the connecting line 4c to the oil cooler 8. Oil at that rate can easily be cooled in the oil cooler 18 to the temperature which is desired for the lubricating oil so that the lubricating oil pump 3 will such cooled oil from the oil cooler 8 through the suction line 2a and will discharge said oil into the lubricating oil circuit 2, in which the lubricating oil is forced through the oil filter 9 and then enters the main lubricating oil passage 2b and flows in the latter to the conventional lubricating points of the engine 1. An automatic control valve 13 will permit the lubricating oil pressure to be controlled as a function of the requirements of a given lubricating system. From the lubricating points the lubricating oil returns to the oil sump 7 and as it flows back is mixed with the hot excess oil from the cooling oil circuit 4 as has been explained hereinbefore. The cool lubricating oil from the lubricating circuit 2 serves also to feed the secondary cooling oil circuit 10, which branches off before the oil filter 9. Depending on the structural design, part of the secondary circuit 10 may be constituted by stub lines 10b, which branch directly from the main lubricating oil passage 2b and serve for piston cooling or for a different internal cooling function.

In order to ensure that the oil level can reliably be checked, a return line 14 for a reverse flow of oil which bypasses the cooling oil pump 5 is provided and contains a pressure-controlled check valve 15. The check valve 15 is connected by a control line 16 to the discharge side of the lubricating oil pump 3 and is opened or closed depending on the pressure of the lubricating oil discharged by the pump 3. As soon as the engine has been stopped so that the lubricating oil pressure drops below a predetermined value, the check valve 15 will open the return line 14 and cooling oil from the cooling oil circuit 4 will quickly flow back to the oil sump 7 so that the quantity of oil which is available can be checked soon after the engine has been stopped. When the engine is started, the lubricating oil pressure will rise above the predetermined limit so that the check valve 15 will close the return line 14 and the cooling oil will properly be pumped through the cooling oil circuit 4.

The check valve 15 may desirably be actuated also as a function of the operating temperature of the engine, e.g., the cylinder head temperature, so that no cooling will be effected if that temperature is below a predetermined limit and the engine can then warm up quickly. For this purpose temperature sensors 18, located in cylinder heads 19, are connected to check valve 15 by means of control line 17. If the check valve 15 is used for an automatic control in such case, the cooling action of the cooling oil circuit 4 can be adaptively controlled under different operating conditions so that the combustion conditions, the fuel consumption and the wear can be influenced in a desirable manner.

Because the cooling oil circuit and the lubricating oil circuit are designed in accordance with the invention, and particularly because only part of the oil used for cooling is delivered to the lubricating oil circuit, and cool lubricating oil from the lubricating oil circuit is used for additional cooling of engine portions from which heat is to be dissipated at a high rate, this internal combustion engine comprises means for an effective cooling also of portions which are subjected to high temperature.

I claim:

1. An internal combustion engine, having portions subject to high temperatures and other portions to be cooled, comprising an oil pan containing an oil sump, a cooling oil circuit, directly connected to said oil sump, containing a cooling oil pump and extending to said other portions to be cooled, a lubricating oil circuit, connected to said cooling oil circuit, and containing an oil cooler, a lubricating oil pump and an oil filter, and secondary cooling oil circuit means, branching from said lubricating oil circuit downstream of said oil cooler, and extending to said portions subject to high temperatures.

2. The internal combustion engine of claim 1, wherein said portions subject to high temperature comprise portions which are to be surface cooled, and wherein said secondary cooling oil circuit means comprise external lines extending to said portions which are to be surface-cooled.

3. The internal combustion engine of claim 2, wherein said portions to be surface-cooled comprise valve-carrying cylinder head webs, and wherein said external lines extend to said webs.

4. The internal combustion engine of claim 1, wherein said portions subject to high temperature comprise portions which are to be internally cooled, wherein said secondary cooling oil circuit means comprise internal lines extending to said portions which are to be internally cooled.

5. The internal combustion engine of claim 4, wherein said portions to be internally cooled comprise piston portions, and wherein said internal lines comprise stub lines extending to said piston portions.

6. The internal combustion engine of claim 1, wherein said lubricating oil pump is located downstream of said oil cooler in said lubricating oil circuit, and wherein said secondary cooling oil circuit means branch from said lubricating oil circuit downstream of said lubricating oil pump.

7. The internal engine of claim 1, wherein said cooling oil pump operates to pump oil at a higher rate than said lubricating oil pump, and said cooling oil circuit comprises cooling means which bypass said lubricating oil circuit and which are arranged to circulate excess oil pumped by said cooling oil pump to said other portions of said engine and to return heated excess oil to said oil sump.

8. The internal combustion engine of claim 7, wherein said cooling oil circuit receives and mixes said heated excess oil from said cooling means, lubricating oil from said lubricating oil circuit, and secondary cooling oil from said secondary cooling oil circuit means, and thereafter returns said mixed oils to said oil sump.

9. The internal combustion engine of claim 1, wherein said oil cooler has an inlet and said oil filter is located downstream of said oil cooler in said lubricating oil circuit and is installed substantially on the same level as said inlet.

10. The internal combustion engine of claim 1, wherein said oil cooler has an inlet and said lubricating oil circuit comprises a riser pipe which is located substantially on the same level as said inlet.

11. The internal combustion engine of claim 1, wherein said cooling oil circuit is connected to said sump by a return line for a return flow which by-passes said cooling oil pump and wherein said return line contains a check valve which is controlled as a function of an operating parameter of said internal combustion engine.

12. The internal combustion engine of claim 11, wherein said check valve is controlled as a function of a pressure in said internal combustion engine.

13. The internal combustion engine of claim 12, wherein said lubricating oil pump has a discharge side, said discharge side is connected to a control line to said check valve and said check valve is arranged to open in response to a pressure drop, below a predetermined value, in said discharge side.

14. The internal combustion engine of claim 11, wherein said check valve is controlled in response to a temperature in said internal combustion engine.

15. The internal combustion engine of claim 14, wherein said internal combustion engine has at least one cylinder head, and wherein, said check valve is arranged to close in response to a temperature rise, above a predetermined value, of said at least one cylinder head.

16. The internal combustion engine of claim 14, wherein said check valve automatically controls said cooling oil circuit as a function of at least one temperature in said internal combustion engine.

* * * * *